US012611075B2

(12) United States Patent
Suzuki et al.

(10) Patent No.: US 12,611,075 B2
(45) Date of Patent: Apr. 28, 2026

(54) TOILET SYSTEM

(71) Applicant: TOTO LTD., Kitakyushu (JP)

(72) Inventors: Kenta Suzuki, Kitakyushu (JP); Tetsuya Uchida, Kitakyushu (JP); Teruyuki Kamori, Kitakyushu (JP); Ryota Takahashi, Kitakyushu (JP); Kaori Nishijima, Kitakyushu (JP); Minoru Sato, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 384 days.

(21) Appl. No.: 18/129,379

(22) Filed: Mar. 31, 2023

(65) Prior Publication Data

US 2023/0309764 A1 Oct. 5, 2023

(30) Foreign Application Priority Data

Mar. 31, 2022 (JP) ..... 2022-059284

(51) Int. Cl.
*A47K 13/30* (2006.01)

(52) U.S. Cl.
CPC ..... *A47K 13/305* (2013.01); *A47K 13/302* (2013.01)

(58) Field of Classification Search
CPC ..... A47K 13/302; A47K 13/305
USPC ..... 4/237
See application file for complete search history.

(56) References Cited

U.S. PATENT DOCUMENTS 10,376,215 B2 * 8/2019 Zhou ..... A61B 5/02233
10,376,246 B2 * 8/2019 Kashyap ..... A47K 13/24
10,760,978 B2 * 9/2020 Zhou ..... G01K 13/20
2016/0374619 A1 * 12/2016 Borkholder ..... A61B 5/7246 600/301
2018/0092602 A1 4/2018 Hall et al.
2020/0289000 A1 9/2020 Hall et al.
(Continued)

FOREIGN PATENT DOCUMENTS

CN 104131607 A 11/2014
CN 108663107 A 10/2018
CN 111436919 A 7/2020
(Continued)

OTHER PUBLICATIONS

Office Action (w/translation) issued in CN Application No. 202310247286.2, issued Aug. 27, 2025 [10 pages].
(Continued)

*Primary Examiner* — Huyen D Le
(74) *Attorney, Agent, or Firm* — IceMiller LLP

(57) ABSTRACT

A toilet system includes: a toilet seat; a sensor configured to measure a physical quantity which reflects blood flow conditions of a user; a health index calculator configured to calculate a plurality of health indices based on measurement results of the sensor; a health index output part configured to output the plurality of health indices which has been calculated; a timer configured to measure a seating time; and a controller configured to control an output manner of the health index output part based on measurement results of the timer. When the seating time is not shorter than a first required time but shorter than a second required time, the first health index is outputted, but the second health index is stopped to be outputted. When the seating time is not shorter than the second required time, both the first health index and the second health index are outputted.

9 Claims, 7 Drawing Sheets

(56) References Cited

U.S. PATENT DOCUMENTS

2022/0279994 A1* 9/2022 Duprieu ..... E03D 9/08

FOREIGN PATENT DOCUMENTS

| | | | |
|---|---|---|---|
| JP | H07-280802 | A | 10/1995 |
| JP | 2021028452 | A | 2/2021 |
| JP | 2021-068396 | A | 4/2021 |
| JP | 2021069813 | A | 5/2021 |
| WO | 2018021627 | A1 | 2/2018 |
| WO | 2019087720 | A1 | 5/2019 |

OTHER PUBLICATIONS

Office Action (w/translation) issued in JP Application No. 2023-140288, issued Sep. 9, 2025 [4 pages].

* cited by examiner

TOILET SYSTEM

BACKGROUND OF THE INVENTION

Technical Field

The present invention pertains to a toilet system that can provide a plurality of health indices of a user.

Background Art

JP-A-2021-68396 has disclosed a system that measures blood flow conditions of a user who sits on a toilet seat, calculates a plurality of health indices based on measurement results thereof, and outputs the calculated health indices (for example, causes a display terminal to display the calculated health indices).

Patent Document List

JP-A-2021-68396

SUMMARY OF THE INVENTION

Technical Problem

As described above, it is already possible to calculate (determine, diagnose) a plurality of health indices of a user, from blood flow conditions of the user under a state wherein the user sits on a toilet seat. For example, based on a Dynamic Light Scattering method, a laser sensor is attached in or on a toilet seat, which can measure blood flow conditions within a skin on a back side of a user's thigh. A Fourier transform or the like is applied to an output signal from the laser sensor so that a plurality of health indices (including a pulse wave, a blood flow amount, a heart rate, or the like) can be calculated (derived).

Herein, an amount of the output signal from the laser sensor (a measurement time by the laser sensor) required to calculate a health index with a certain degree of accuracy (reliability) may be different for each health index. or example, with respect to a "heart rate", a calculated value thereof with a certain degree of accuracy (reliability) can be obtained from an output waveform signal corresponding to 10 seconds (measurement time). On the other hand, with respect to a "vascular age" and a "stress state," it is required to use an output waveform signal corresponding to 60 seconds (measurement time) to obtain a calculated value thereof with a certain degree of accuracy (reliability).

Conventionally, an output is made only after all calculated values of a plurality of health indices desired by a user have been obtained. Therefore, when a "vascular age" and/or a "stress state (Calmness Level)" are desired, 60 seconds is required as a seating time. If the seating time is less than 60 seconds, no health index is output. However, if no health index is output in this way, it is impossible or at least difficult to distinguish such a situation from a possible malfunction of the toilet system.

The present inventors have found that, in such a case, if a user desires that an output is partially made for a health index, for example a heart rate, which can be calculated during a short seating time, for example 10 seconds, making such a partial output is convenient for the user. Specifically, for example, if a "stress state" and a "heart rate" are desired (selected), when the seating time is less than 60 seconds (for example, for urinating), none of both is outputted in the conventional toilet system. However, if a calculated value for a "heart rate" is partially outputted, it might be useful for the user. In addition, the user is freed from worry about a possible malfunction of the toilet system.

The present invention has been made based on the above findings by the inventors. The object of the present invention is to provide a toilet system that can provide a plurality of health indices of a user and that can output a part of the plurality of health indices depending on a seating time of the user.

Solution to Problem

One aspect of the present invention is a toilet system including: a toilet seat having a seat surface on which a user is to sit; a sensor provided in or on the toilet seat, configured to measure a physical quantity which reflects blood flow conditions of the user; a health index calculator configured to calculate a plurality of health indices of the user based on measurement results of the sensor; a health index output part configured to output the plurality of health indices of the user which has been calculated by the health index calculator; a timer configured to measure a seating time during which the user continues to sit on the seat surface; and a controller configured to control an output manner of the health index output part based on measurement results of the timer; wherein the plurality of health indices includes a first health index and a second health index; the health index calculator is configured to calculate the first health index by taking a first required time under a state wherein the user continues to sit on the seat surface, and to calculate the second health index by taking a second required time under a state wherein the user continues to sit on the seat surface, the second required time being longer than the first required time; the controller is configured to cause the health index output part to: (1) output the first health index which has been calculated by the health index calculator in a default manner, but handle the second health index which has been calculated by the health index calculator in a different manner than the default manner (for example, 1: does not display the calculated results, 2: display the previous calculated results when the user sat on the seat surface last time (=does not update the calculated results), 3: display a representative value to date (for example, an average value for a newly updatable specific period of time), 4: display the current measurements (fluctuations before finalization), 5: display a "message", such as "during measurement", including an error message), when the seating time is not shorter than the first required time but shorter than the second required time; and (2) output the first health index which has been calculated by the health index calculator in the default manner, and also output the second health index which has been calculated by the health index calculator in the default manner, when the seating time is not shorter than the second required time.

According to the above aspect, when the seating time is not shorter than the first required time but shorter than the second required time, the first health index, which has not been outputted in this case in the conventional system, can be outputted. This output may be useful for the user. In addition, the user is freed from worry about a possible malfunction of the toilet system. In addition, it is preferable that the controller is configured to cause the health index output part to: (3) handle the first health index which has been calculated by the health index calculator in the different manner or in a second different manner than the default manner, and handle the second health index which has been calculated by the health index calculator in the different manner, in the second different manner or in a third different manner than the default manner, when the seating time is shorter than the first required time.

According to this manner, when the seating time is shorter than the first required time, any health index that is likely to incorrectly reflect the user's actual health status is stopped to be outputted, or such an error message or error information is outputted together with (or instead of) an output of any health index that is likely to incorrectly reflect the user's actual health status. Thus, it is effectively inhibited that any health index that is likely to incorrectly reflect the user's actual health status is outputted as correctly reflecting the user's actual health status. Therefore, it is effectively inhibited that unnecessary confusion and/or upset is given to the user who daily takes care of his or her health with reference to the health indices obtained via the toilet system.

Another aspect of the present invention is a toilet system including: a toilet seat having a seat surface on which a user is to sit; a sensor provided in or on the toilet seat, configured to measure a physical quantity which reflects blood flow conditions of the user; a health index calculator configured to calculate a plurality of health indices of the user based on measurement results of the sensor; a health index output part configured to output the plurality of health indices of the user which has been calculated by the health index calculator; a timer configured to measure a seating time during which the user continues to sit on the seat surface; and a controller configured to control an output manner of the health index output part based on measurement results of the timer; wherein the plurality of health indices includes a first health index and a second health index; the health index calculator is configured to calculate a first calculated value of the first health index by taking a first required time under a state wherein the user continues to sit on the seat surface, to calculate the second health index by taking a second required time under a state wherein the user continues to sit on the seat surface, the second required time being longer than the first required time, and to calculate a second calculated value of the first health index at a predetermined timing after the first required time has elapsed under a state wherein the user continues to sit on the seat surface; the controller is configured to cause the health index output part to: (1) output the first calculated value of the first health index which has been calculated by the health index calculator in a default manner, but handle the second health index which has been calculated by the health index calculator in a different manner than the default manner, when the seating time is not shorter than the first required time but shorter than the second required time; and (2) output the second calculated value of the first health index which has been calculated by the health index calculator in the default manner, and output the second health index which has been calculated by the health index calculator in the default manner, when the seating time is not shorter than the second required time.

According to the above aspect as well, when the seating time is not shorter than the first required time but shorter than the second required time, the first health index, which has not been outputted in this case in the conventional system, can be outputted. This output may be useful for the user. In addition, the user is freed from worry about a possible malfunction of the toilet system. Furthermore, according to the above aspect, when the seating time is not shorter than the second required time, the second calculated value of the first health index, which has been calculated with a higher degree of accuracy by taking a longer time, is outputted instead of the first calculated value of the first health index. This is more useful for the user who daily takes care of his or her health with reference to the health indices obtained via the toilet system.

In this aspect as well, it is preferable that the controller is configured to cause the health index output part to: (3) handle the first health index which has been calculated by the health index calculator in the different manner or in a second different manner than the default manner, and handle the second health index which has been calculated by the health index calculator in the different manner, in the second different manner or in a third different manner than the default manner, when the seating time is shorter than the first required time.

According to this manner, when the seating time is shorter than the first required time, any health index that is likely to incorrectly reflect the user's actual health status is stopped to be outputted, or such an error message or error information is outputted together with (or instead of) an output of any health index that is likely to incorrectly reflect the user's actual health status. Thus, it is effectively inhibited that any health index that is likely to incorrectly reflect the user's actual health status is outputted as correctly reflecting the user's actual health status. Therefore, it is effectively inhibited that unnecessary confusion and/or upset is given to the user who daily takes care of his or her health with reference to the health indices obtained via the toilet system.

In addition, in the above two aspects, it is preferable that the plurality of health indices includes one or a first group of health indices each of which functions as the first health index and a second group of health indices each of which functions as the second health index, and that the number of the second group of health indices is larger than the number of the first group of health indices. Even if the number of the second group of health indices (each of which functions as the second health index, whose calculation requires a more amount of measured data (more data points) of the blood flow conditions) is larger than the number of the first group of health indices (each of which functions as the first health index), at least the first health index (the health indices of the first group) can be outputted when the seating time is short. Thus, it is possible to adopt a large number of the second group of health indices even if there is some limitation for calculation of the health indices to be equipped with.

The present invention should be also protected as a method category. That is to say, a method according to an aspect of the present invention is a method of providing a health index by using a toilet system, the toilet system including: a toilet seat having a seat surface on which a user is to sit; a sensor provided in or on the toilet seat, configured to measure a physical quantity which reflects blood flow conditions of the user; and a timer configured to measure a seating time during which the user continues to sit on the seat surface; the method including: a health index calculating step of calculating a plurality of health indices of the user based on measurement results of the sensor; and a health index outputting step of outputting the plurality of health indices of the user which has been calculated by the health index calculating step, in accordance with an output manner depending on measurement results of the timer; wherein the plurality of health indices includes a first health index and a second health index; during the health index calculating step, the first health index is calculated by taking a first required time under a state wherein the user continues to sit on the seat surface, and the second health index is calculated by taking a second required time under a state wherein the user continues to sit on the seat surface, the second required time being longer than the first required time; during the health index outputting step: (1) the first health index which has been calculated by the health index calculating step is outputted in a default manner, but the second health index which has been calculated by the health index calculating step is handled in a different manner than the default manner, when the seating time is not shorter than the first required time but shorter than the second required time, and (2) the first health index which has been calculated by the health index calculating step is outputted in the default manner, and the second health index which has been calculated by the health index calculating step is also outputted in the default manner, when the seating time is not shorter than the second required time.

Alternatively, a method according to another aspect of the present invention is a method of providing a health index by using a toilet system, the toilet system including: a toilet seat having a seat surface on which a user is to sit; a sensor provided in or on the toilet seat, configured to measure a physical quantity which reflects blood flow conditions of the user; and a timer configured to measure a seating time during which the user continues to sit on the seat surface; the method including: a health index calculating step of calculating a plurality of health indices of the user based on measurement results of the sensor; and a health index outputting step of outputting the plurality of health indices of the user which has been calculated by the health index calculating step, in accordance with an output manner depending on measurement results of the timer; wherein the plurality of health indices includes a first health index and a second health index; during the health index calculating step, a first calculated value of the first health index is calculated by taking a first required time under a state wherein the user continues to sit on the seat surface, the second health index is calculated by taking a second required time under a state wherein the user continues to sit on the seat surface, the second required time being longer than the first required time, and a second calculated value of the first health index is calculated at a predetermined timing after the first required time has elapsed under a state wherein the user continues to sit on the seat surface; during the health index outputting step: (1) the first calculated value of the first health index which has been calculated by the health index calculating step is outputted in a default manner, but the second health index which has been calculated by the health index calculating step is handled in a different manner than the default manner, when the seating time is not shorter than the first required time but shorter than the second required time, and (2) the second calculated value of the first health index which has been calculated by the health index calculating step is outputted in the default manner, and the second health index which has been calculated by the health index calculating step is also outputted in the default manner, when the seating time is not shorter than the second required time.

The present invention should be also protected as a program category. That is to say, a program according to an aspect of the present invention is a program for providing a health index by using a toilet system, the toilet system including: a toilet seat having a seat surface on which a user is to sit; a sensor provided in or on the toilet seat, configured to measure a physical quantity which reflects blood flow conditions of the user; and a timer configured to measure a seating time during which the user continues to sit on the seat surface; the program being capable of perform, when executed by a computer: a health index calculating step of calculating a plurality of health indices of the user based on measurement results of the sensor; and a health index outputting step of outputting the plurality of health indices of the user which has been calculated by the health index calculating step, in accordance with an output manner depending on measurement results of the timer; wherein the plurality of health indices includes a first health index and a second health index; during the health index calculating step, the first health index is calculated by taking a first required time under a state wherein the user continues to sit on the seat surface, and the second health index is calculated by taking a second required time under a state wherein the user continues to sit on the seat surface, the second required time being longer than the first required time; during the health index outputting step: (1) the first health index which has been calculated by the health index calculating step is outputted in a default manner, but the second health index which has been calculated by the health index calculating step is handled in a different manner than the default manner, when the seating time is not shorter than the first required time but shorter than the second required time, and (2) the first health index which has been calculated by the health index calculating step is outputted in the default manner, and the second health index which has been calculated by the health index calculating step is also outputted in the default manner, when the seating time is not shorter than the second required time.

Alternatively, a program according to another aspect of the present invention is a program for providing a health index by using a toilet system, the toilet system including: a toilet seat having a seat surface on which a user is to sit; a sensor provided in or on the toilet seat, configured to measure a physical quantity which reflects blood flow conditions of the user; and a timer configured to measure a seating time during which the user continues to sit on the seat surface; the program being capable of perform, when executed by a computer: a health index calculating step of calculating a plurality of health indices of the user based on measurement results of the sensor; and a health index outputting step of outputting the plurality of health indices of the user which has been calculated by the health index calculating step, in accordance with an output manner depending on measurement results of the timer; wherein the plurality of health indices includes a first health index and a second health index; during the health index calculating step, a first calculated value of the first health index is calculated by taking a first required time under a state wherein the user continues to sit on the seat surface, the second health index is calculated by taking a second required time under a state wherein the user continues to sit on the seat surface, the second required time being longer than the first required time, and a second calculated value of the first health index is calculated at a predetermined timing after the first required time has elapsed under a state wherein the user continues to sit on the seat surface; during the health index outputting step: (1) the first calculated value of the first health index which has been calculated by the health index calculating step is outputted in a default manner, but the second health index which has been calculated by the health index calculating step is handled in a different manner than the default manner, when the seating time is not shorter than the first required time but shorter than the second required time, and (2) the second calculated value of the first health index which has been calculated by the health index calculating step is outputted in the default manner, and the second health index which has been calculated by the health index calculating step is also outputted in the default manner, when the seating time is not shorter than the second required time.

Advantageous Effects of Invention

According to one aspect of the present invention, when the seating time is not shorter than the first required time but shorter than the second required time, the first health index, which has not been outputted in this case in the conventional system, can be outputted. This output may be useful for the user. In addition, the user is freed from worry about a possible malfunction of the toilet system.

Alternatively, according to another aspect of the present invention, when the seating time is not shorter than the first required time but shorter than the second required time, the first health index, which has not been outputted in this case in the conventional system, can be outputted. This output may be useful for the user. In addition, the user is freed from worry about a possible malfunction of the toilet system. Furthermore, according to the above aspect, when the seating time is not shorter than the second required time, the second calculated value of the first health index, which has been calculated with a higher degree of accuracy by taking a longer time, is outputted instead of the first calculated value of the first health index. This is more useful for the user who daily takes care of his or her health with reference to the health indices obtained via the toilet system.

DETAILED DESCRIPTION OF THE EMBODIMENTS

Structure

Figure 1:
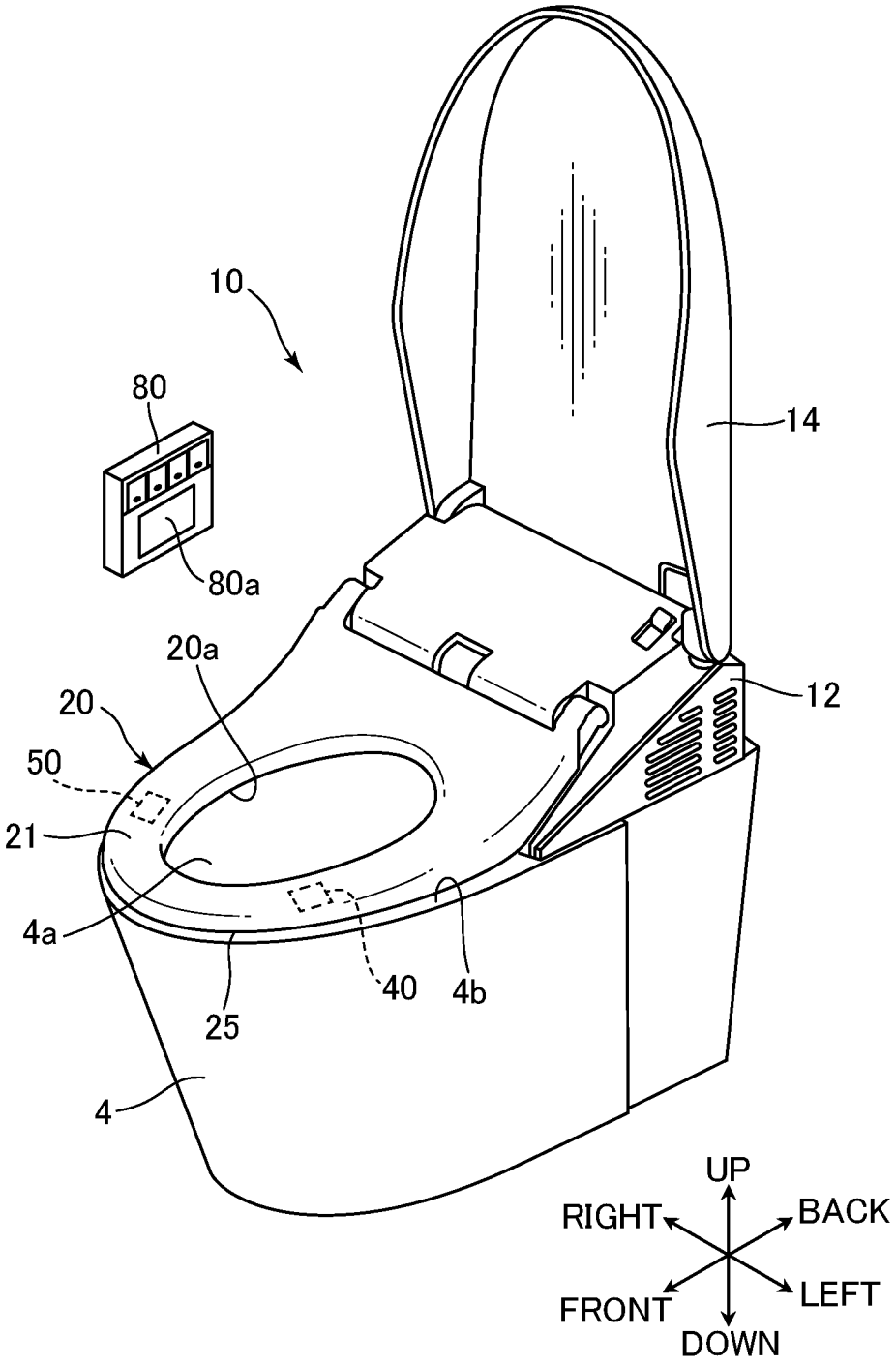
FIG. 1 is a schematic perspective view of a toilet system according to an embodiment of the present invention.

Hereinafter, an embodiment of the present invention is explained with reference to the attached drawings. FIG. 1 is a schematic perspective view of a toilet system 10 according to an embodiment of the present invention, FIG. 2 is an exploded perspective view of a toilet seat 20 of the toilet system 10 shown in FIG. 1, and FIG. 3 is a schematic block view showing main components of the toilet system 10 shown in FIG. 1.

Figure 2:
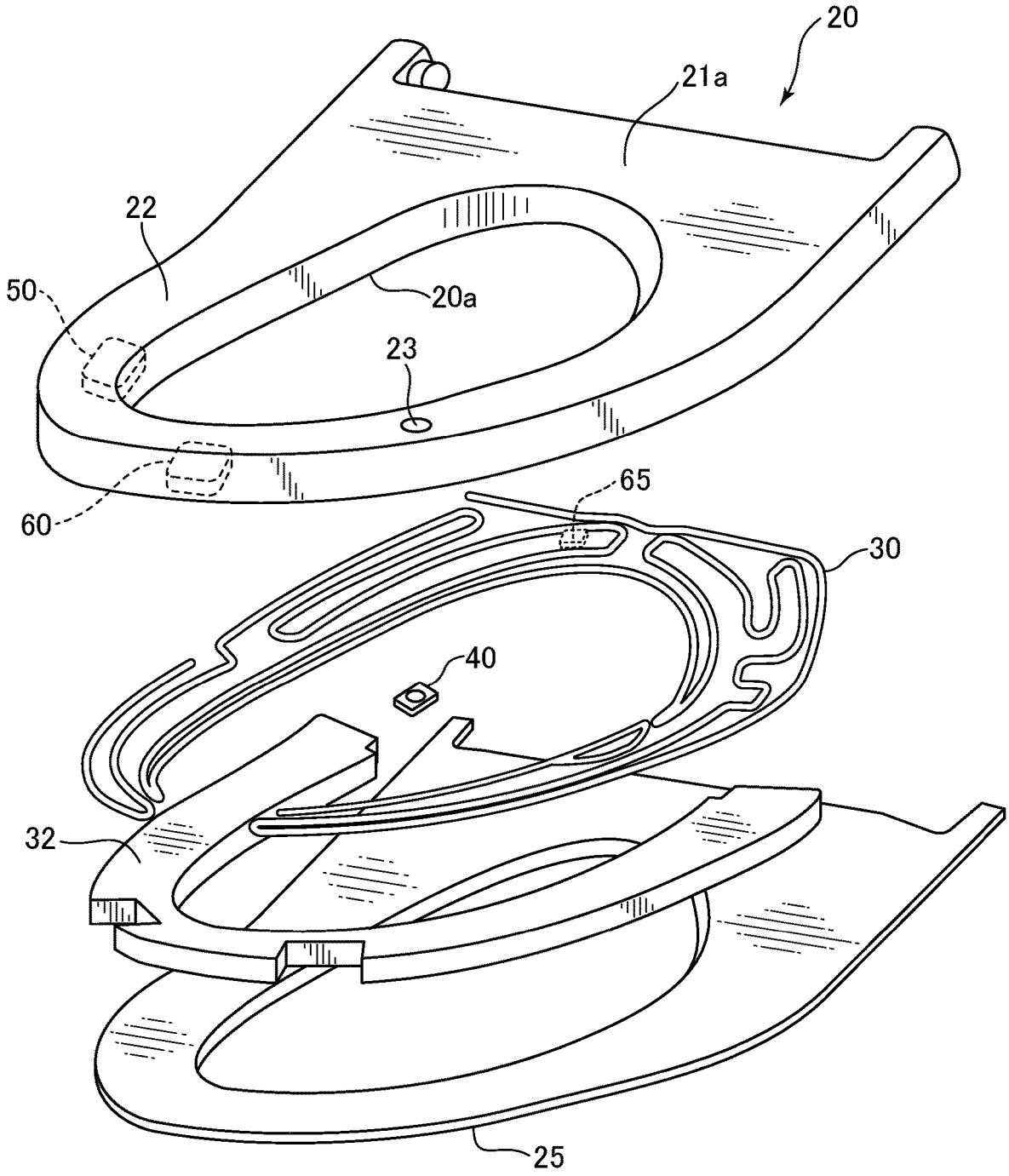
FIG. 2 is an exploded perspective view of a toilet seat of the toilet system shown in FIG. 1.
Figure 3:
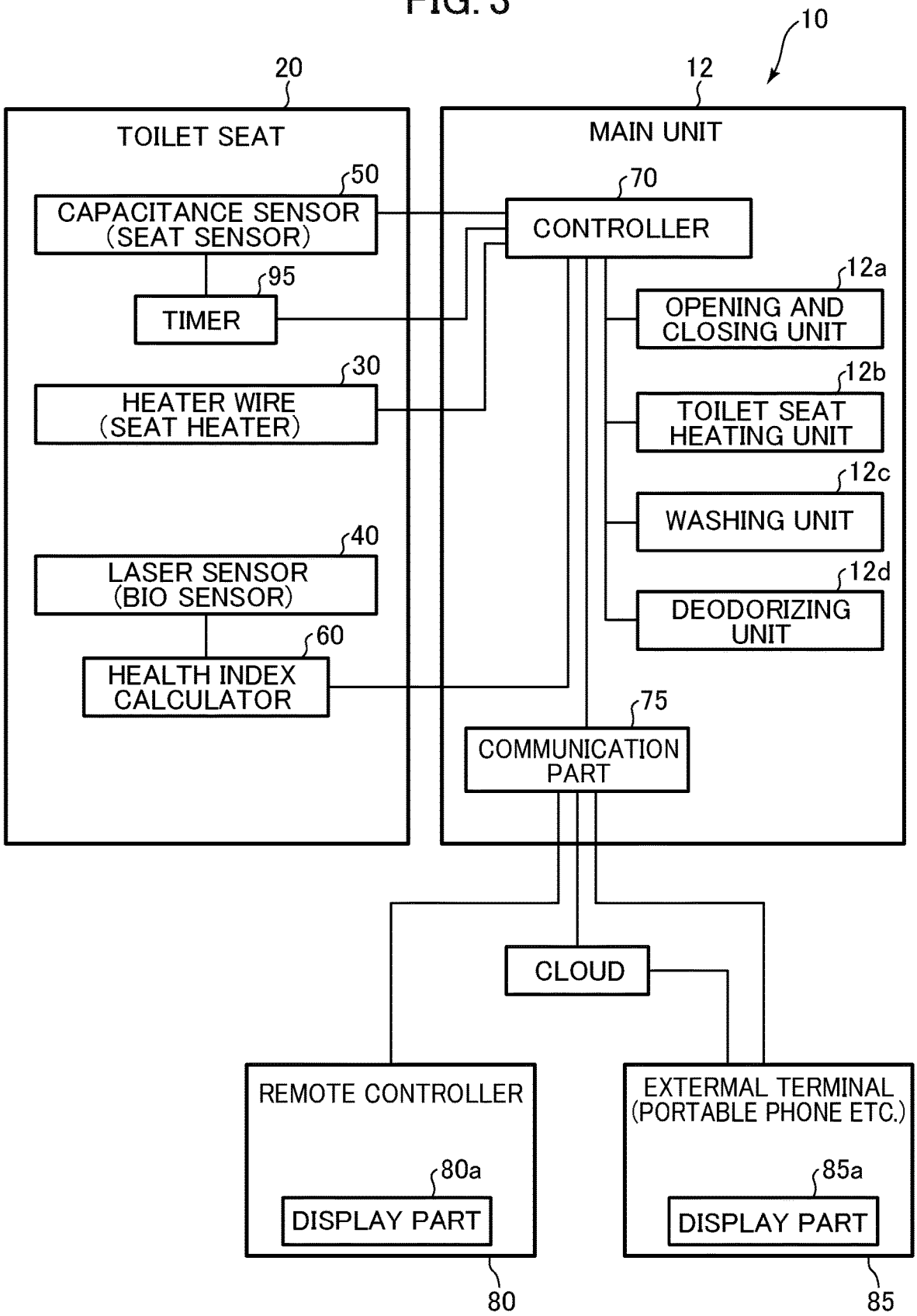
FIG. 3 is a schematic block view showing main components of the toilet system shown in FIG. 1.

As shown in FIGS. 1 to 3, the toilet system 10 of the present embodiment includes a toilet seat 20, a main unit 12 and a toilet cover 14. The toilet seat 20 and the toilet cover 14 are supported by the main unit 12 in a pivotable manner with respect to the main unit 12.

A laser sensor 40 is provided as a sensor that measures a physical quantity which reflects blood flow conditions of a user. A capacitance sensor 50 is provided as a seat sensor (seat occupancy sensor). A health index calculator 60 (specifically, for example, a microprocessor), which is configured to calculate a plurality of health indices of the user based on measurement results by the laser sensor 40, is provided in the toilet seat 20.

The toilet seat 20 has an opening part 20*a*. In the present embodiment, an O-shaped opening 20*a* is formed in a central area of the toilet seat 20. The opening of the toilet seat 20 is not limited to such an O-shaped opening, but also may be a U-shaped opening. An outer periphery of the toilet seat 20 is curved along an outside contour of a toilet bowl unit 4. The toilet seat 20 is generally made of opaque resin (for example, polypropylene), and has a seat surface 21 on which a user is to sit and has a bottom surface 25 opposite to the seat surface 21.

The seat surface 21 is a surface exposed upward under a state wherein the toilet seat 20 is placed on an upper surface 4*b* of the toilet bowl unit 4 (wherein the toilet seat 20 is lowered). The bottom surface 25 is a surface facing to the upper surface 4*b* of the toilet bowl unit 4 under the same state wherein the toilet seat 20 is placed on the upper surface 4*b* of the toilet bowl unit 4 (wherein the toilet seat 20 is lowered). The substantially whole of the toilet seat 20 is consists of a thick-walled portion 22, but a thin-walled portion 23, which is thinner than the thick-walled part 22, is formed locally at a position which the laser sensor 40 corresponds to.

As shown in FIG. 2, a heater wire 30 (an example of a heater) and an insulator 32 are provided in the toilet seat 20 to heat or keep warm the seat surface 21. The heater wire 30 is configured to be controlled by a toilet seat heating unit 12*b* provided in the main part 12 and is stretched around the inside of the toilet seat 20 so as not to interfere with the laser sensor 40, the capacitance sensor 50 and the health index calculator 60. The insulator 32 is arranged below the heater wire 30, the laser sensor 40, the capacitance sensor 50 and the health index calculator 60.

The thin-walled portion 23 is so thin that an irradiated light from the laser sensor 40 and a reflected light from the user who sits on the seat surface 21 are transmissive therethrough. The thickness of the thin-walled portion 23 is set according to intensity of the irradiated light from the laser sensor 40 and intensity of the reflected light from the user, and according to durability of the toilet seat 20, and the like. For example, the thickness of the thin-walled portion 23 is about 0.5 mm to 1.0 mm.

As used herein, the terms "up", "down", "front", "back", "left" and "right" refer to directions viewed from a user sitting on the toilet seat 20 with his or her back facing to the opened toilet cover 14, respectively.

As shown in FIG. 2, the thin-walled portion 23 is formed on the left side and on the front side than the center of the length of the opening 20*a* of the toilet seat 20 in the front-back direction. That is to say, the thin-walled portion 23 is located on the left side forward from the center of gravity of a user who sits on the toilet seat 20. Thereby, the thin-walled portion 23 faces to (abuts to) a skin on a back side of the user's left thigh.

The thin-walled portion 23 is formed as small as possible to the extent that the laser sensor 40 can detect blood flow information of the user who sits on the toilet seat 20. For example, the thin-walled portion 23 has a circular shape with a diameter of 12 mm or less (preferably, 8 mm or less).

Figure 4:
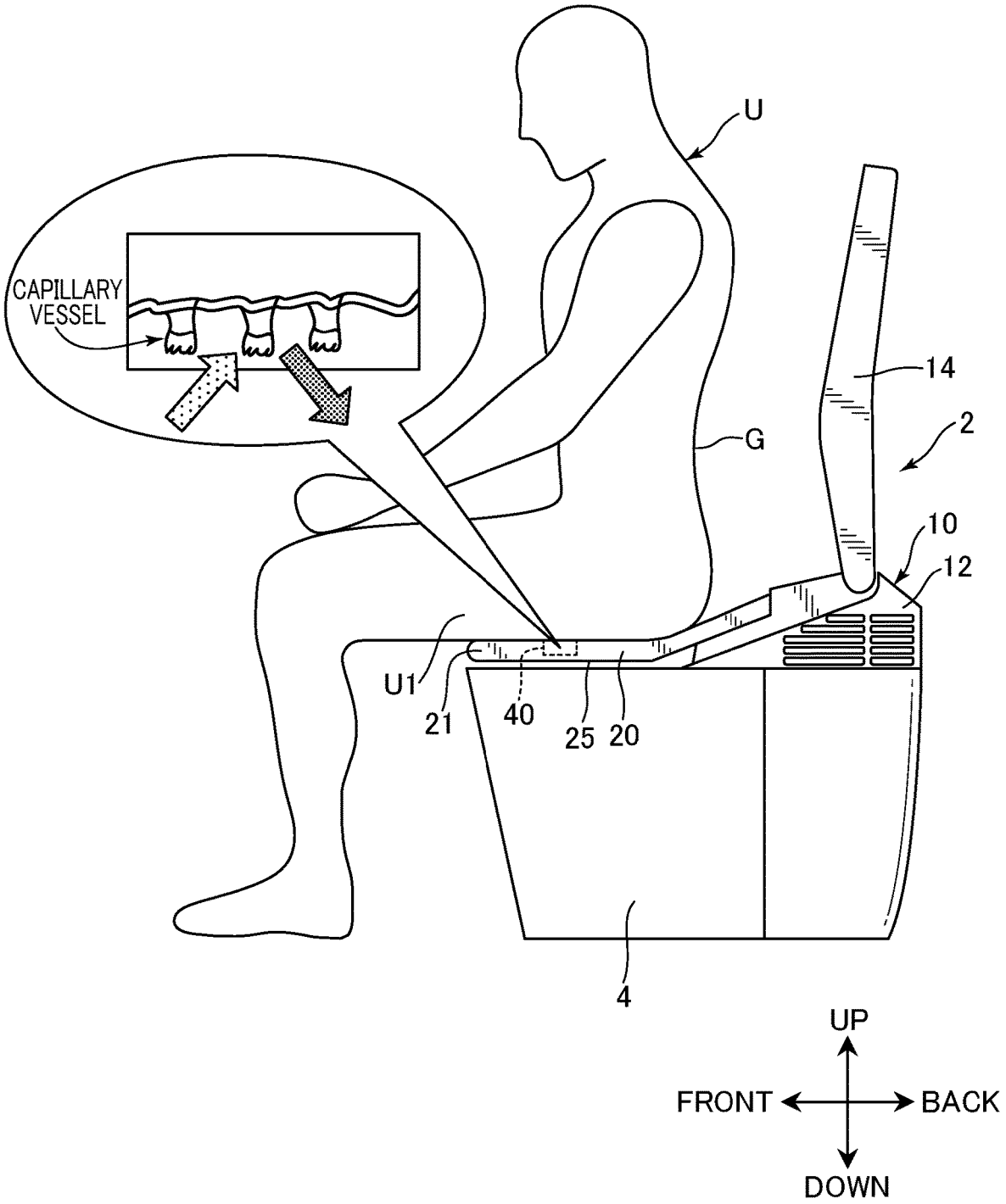
FIG. 4 is a schematic view showing a structure of a laser sensor of the toilet system shown in FIG. 1.

The laser sensor 40 is located on a back side of the thin-walled portion 23 in the toilet seat 20. The laser sensor 40 is a reflective type of sensor that emits an infrared irradiation light toward the back side of the user's left thigh and detects a reflected light (a scattered light resulting from Doppler Shift by red blood cells) that has been reflected according to blood flow conditions in a subcutaneous blood vessel. FIG. 4 is a schematic view showing a structure of the laser sensor 40.

On the other hand, as shown in FIGS. 1 and 2, the capacitance sensor 50 is arranged on the right side and on the front side than the center of the length of the opening 20*a* of the toilet seat 20 in the front-back direction. That is to say, the capacitance sensor 50 is located on the right side forward from the center of gravity of a user who sits on the toilet seat 20. Thereby, the capacitance sensor 50 faces to (abuts to) a skin on a back side of the user's right thigh, and then the capacitance sensor 50 can detect the user's sitting state (seat occupancy).

Figure 5:
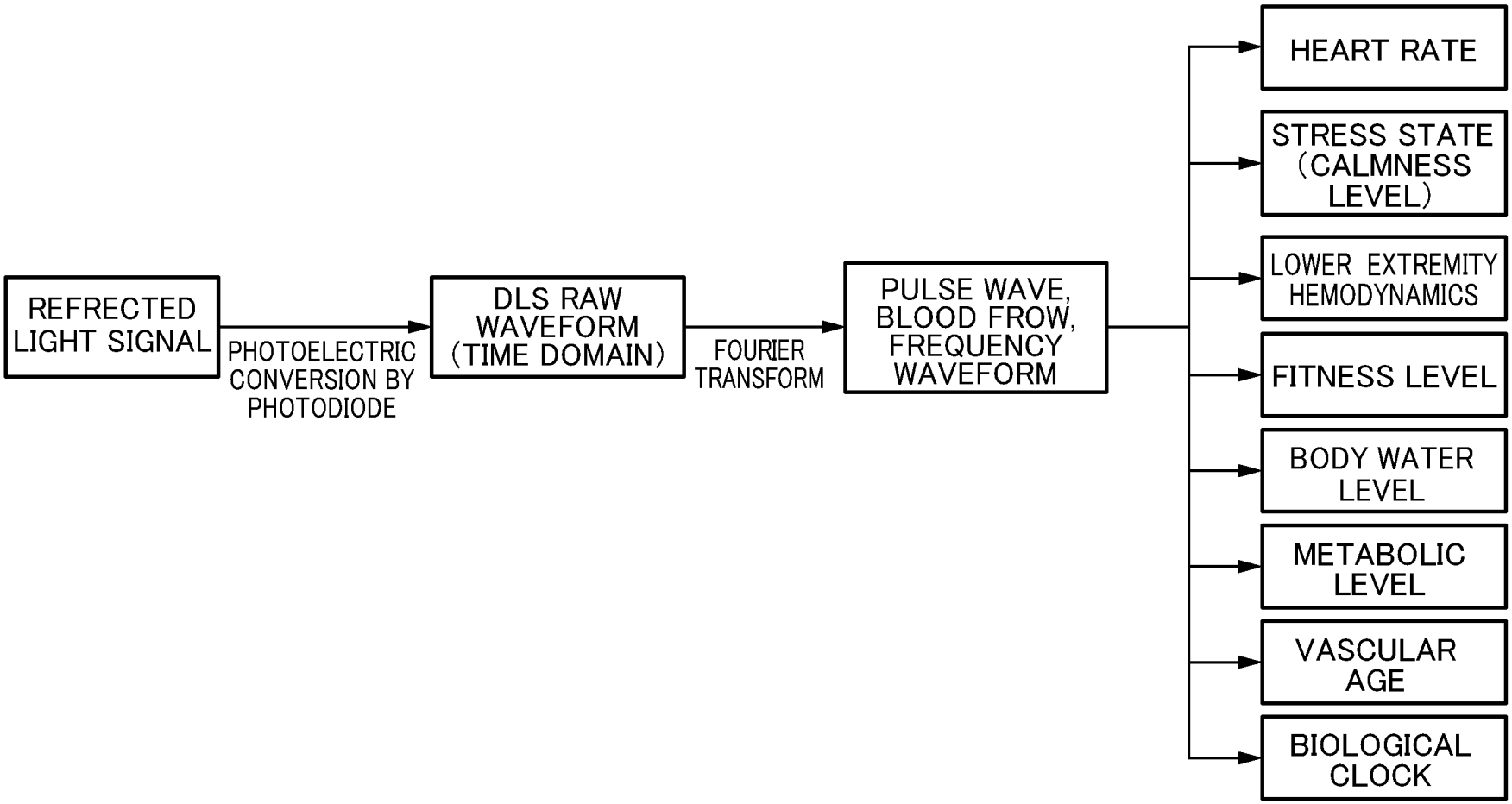
FIG. 5 is a schematic view showing a process for calculating various health indices based on measurement results of the laser sensor shown in FIG. 4.

In the present embodiment, the health index calculator 60 is arranged in the vicinity of a front end of the toilet seat 20 (at a position relatively close to the laser sensor 40), and is configured to process an output signal of the laser sensor 40 and transform it to a noise-resistant signal. Specifically, the health index calculator 60 is configured to calculate a plurality of health indices (specifically, for example, a pulse rate, a pulse variability, a blood flow amount) of the user who sits on the toilet seat 20 based on the measurement results of the laser sensor 40, and to transmit a signal corresponding to the calculated results to a communication part 75 via a controller 70. FIG. 5 is a schematic view showing a process for calculating various health indices based on the measurement results of the laser sensor 40.

The controller 70 and the communication part 75 are arranged in the main unit 12. The health index calculator 60 may be arranged in the main unit 12, instead of in the toilet seat 20. When the health index calculator 60 is arranged in the main unit 12, the health index calculator 60 may be provided separately from the controller 70 or integrated with the controller 70 as a part thereof. In addition, the health index calculator 60 and the controller 70 may be provided (set up) in an external device or an external network (for example, a cloud network) communicable via the communication part 75, instead of in the main unit 12.

With reference to FIG. 1 again, the main unit 12 is attached on the upper surface 4*b* of the toilet bowl unit 4 on the back side than a bowl portion of the toilet bowl unit 4. An opening and closing unit 12*a* configured to control an opening and losing operation for each of the toilet seat 20 and cover 14, a toilet seat heating unit 12*b* configured to control a temperature of the toilet seat 20, a washing unit 12*c* configured to wash a portion of the user's body, and a deodorizing unit 12*d* configured to reduce odorous components, are arranged in the main unit 12. The respective units 12*a* to 12*d* are controlled by the controller 70 comprehensively. The controller 70 is also connected to the capacitance sensor 50.

The controller 70 of the present embodiment is connected to the communication part 75 (an example of a health index output unit) for outputting the plurality of health indices of the user which has been calculated by the health index calculator 60. The communication part 75 is configured to transmit the calculated health indices of the user to, for example, a remote controller 80 in the toilet room or a portable terminal 85 of the user. Thereby, the user who sits on the toilet seat 20 can check various health indices (vital signs such as a pulse rate, etc.) by a display part 80*a* of the remote controller 80 and/or by a display part 85*a* of the portable terminal 85.

The toilet system 10 of the present embodiment has a timer 95 configured to measure a seating time during which the user continues to sit on the seat surface 21 by cooperating with the capacitance sensor 50 (an example of a seat sensor). The timer 95 is also connected to the controller 70.

Herein, as described above, an amount of the output signal from the laser sensor 40 (a measurement time by the laser sensor 40) required to calculate a health index with a certain degree of accuracy (reliability) may be different for each health index.

In the present embodiment, with respect to a "heart rate" (an example of a first health index), a first calculated value thereof with a certain degree of accuracy (reliability) can be obtained from an output waveform signal corresponding to 10 seconds (measurement time) (an example of a reminder of subtraction of a computation time (for example, 1 second) from a first required time). On the other hand, with respect to a "stress state" (an example of a second health index), a calculated value thereof with a certain degree of accuracy (reliability) can be obtained from an output waveform signal corresponding to 60 seconds (measurement time) (an example of a reminder of subtraction of a computation time from a second required time).

A "vascular age", a "metabolic level", a "hemodynamic status", a "biological clock", a "fitness level", and a "body water level" may be also listed as an example of a second health index.

In addition, in the present embodiment, the number of the (second group of) health indices each of which functions as a second health index is larger than the number of the (first group of) health indices each of which functions as a first health index. Even if the number of the (second group of) health indices each of which functions as a second health index, whose calculation requires a more amount of measured data (more data points) of the blood flow conditions, is larger than the number of the (first group of) health indices each of which functions as a first health index, at least the first health index (the health indices of the first group) can be outputted when the seating time is short. Thus, it is possible to adopt a large number of the (second group of) health indices each of which functions as a second health index even if there is some limitation for calculation of the health indices to be equipped with.

Furthermore, in the present embodiment, for a second operation example which will be described later, with respect to the "heart rate", a second calculated value thereof with a higher degree of accuracy (reliability) can be obtained from an output waveform signal corresponding to 60 seconds (measurement time) (an example of a reminder of subtraction of a computation time from a second required time).

In addition, in the present embodiment, the controller 70 is configured to determine whether the user sits (continues to sit) on the seat surface 21, based on the measurement results of the capacitance sensor 50, as a seat occupancy determining part. Furthermore, the controller 70 is configured to determine whether the seating time (elapsed time since the user sat on the seat surface 21) is not shorter than 11 seconds (an example of a first required time) and to determine whether the seating time is not shorter than 61 seconds (an example of a second required time), based on the measurement results of the timer 95, as a seating time determining part.

Furthermore, based on the determined results, the controller 70 is configured to cause the communication part 75 (health index output part) to: (0) stop outputting the "heart rate" (an example of a first health index) and stop outputting the "stress state" (an example of a second health index), when the seating time is shorter than 11 seconds (an example of a first required time), (1) output the first calculated value of the "heart rate", but stop outputting the "stress state", when the seating time is not shorter than 11 seconds (an example of a first required time) but shorter than 61 seconds (an example of a second required time), and (2) output the calculated "heart rate" (the first calculated value in a first operation example which will be described later, or the second calculated value in the second operation example which will be described later) and also output the calculated "stress state", when the seating time is not shorter than 61 seconds (an example of a second required time).

In the present embodiment, a health index is stopped to be outputted when the seating time is shorter than a predetermined required time corresponding to the health index. However, it is enough that a health index obtained based on blood flow information under a condition shorter than the predetermined required time is not outputted. For example, a previously calculated health index based on blood flow information under a state wherein a user had sat on the seat surface 21 last time may continue to be outputted.

First Operation Example: Operation

Figure 6:
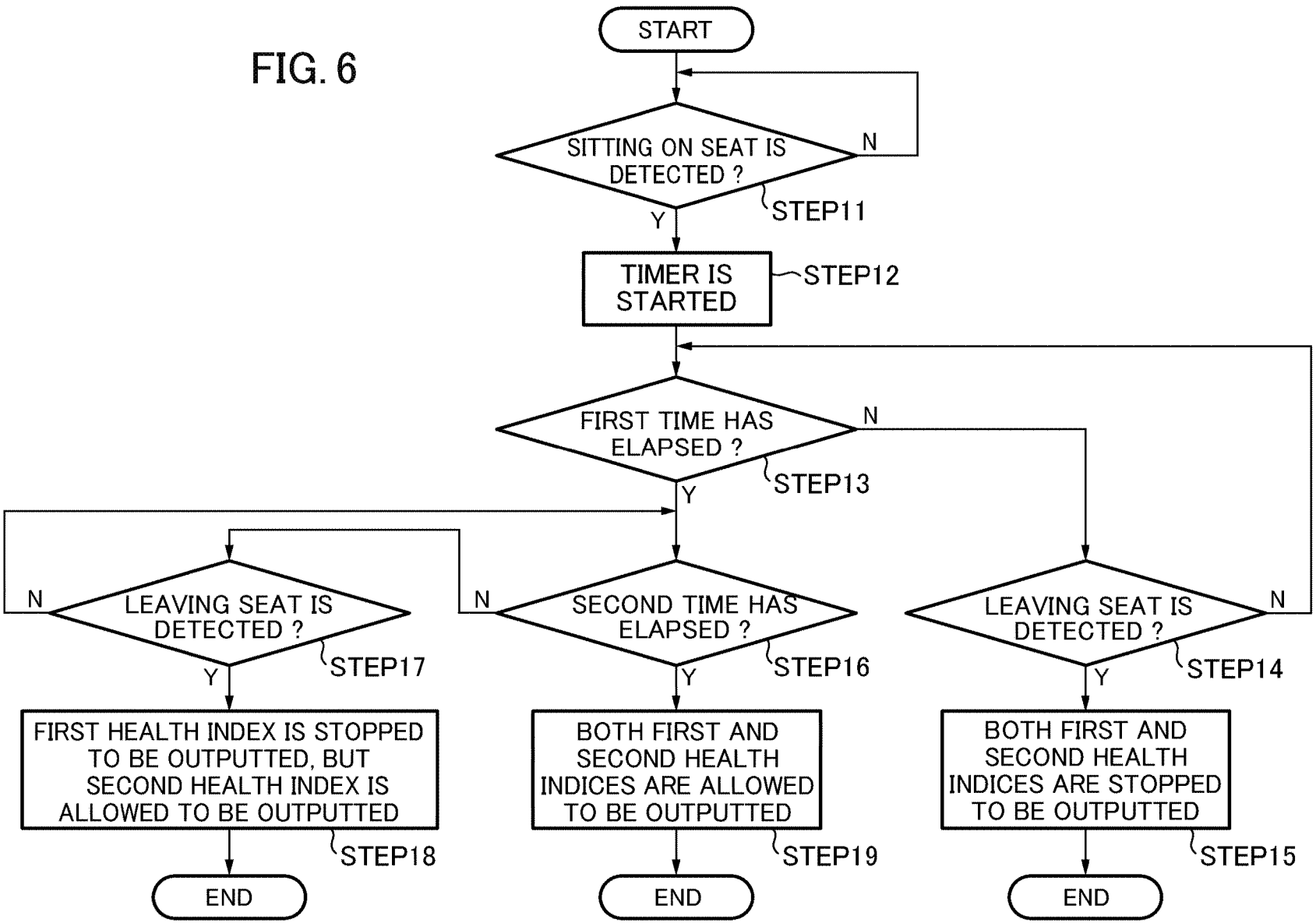
FIG. 6 is a flowchart showing a first operation example of the toilet system shown in FIG. 1.

A first operation example of the toilet system 10 according to the present embodiment is explained with reference to FIG. 6. As shown in FIG. 6, the controller 70 determines whether a user sits on the seat surface 21 or not (STEP 11). When it is determined that no user has sat on the seat surface 21 yet (NO at STEP 11), this determining step is repeatedly performed.

When it is determined that a user has sat on the seat surface 21 (YES at STEP 11), a measurement of a seating time by the timer 95 is started (STEP 12). In parallel, a calculation process for a plurality of health indices of the user is started by the health index calculator 60 based on measurement results of the laser sensor 40 (in this example, a "heart rate" is calculated by taking 11 seconds (an example of a first required time), and a "stress state" is calculated by taking 61 seconds (an example of a second required time)).

Subsequently, the controller 70 determines whether the seating time has reached or exceeded 11 seconds (an example of a first required time) (YES) or has not reached 11 seconds yet (NO) (STEP 13).

Before the seating time reaches 11 seconds (NO at STEP 13), if the capacitance sensor 50 detects the user's leaving the seat surface 21 (YES at STEP 14), the controller 70 is configured to cause the communication part 75 (health index output part) to stop outputting the "heart rate" (an example of a first health index) and also to stop outputting the "stress state" (an example of a second health index) (STEP 15).

After the seating time has reached or exceeded 11 seconds (YES at STEP 13), subsequently, the controller 70 determines whether the seating time has reached or exceeded 61 seconds (an example of a second required time) (YES) or has not reached 61 seconds yet (NO) (STEP 16).

Before the seating time reaches 61 seconds (NO at STEP 16), while the capacitance sensor 50 does not detect the user's leaving the seat surface 21 (NO at STEP 17), it is waited for the seating time to reach or exceed 61 seconds (back to STEP 16).

Before the seating time reaches 61 seconds (NO at STEP 16), if the capacitance sensor 50 detects the user's leaving the seat surface 21 (YES at STEP 17), the controller 70 is configured to cause the communication part 75 (health index output part) to output (the first calculated value of) the "heart rate" but stop outputting the "stress state" (STEP 18).

After the seating time has reached or exceeded 61 seconds (YES at STEP 16), the controller 70 is configured to cause the communication part 75 (health index output part) to output (the first calculated value of) the "heart rate" and also output the "stress state" (STEP 19).

First Operation Example: Effect

According to the first operation example as described above, when the seating time is not shorter than 11 seconds but shorter than 61 seconds, the calculated value of the "heart rate", which has not been outputted in this case in the conventional system, can be outputted. This output may be useful for the user. In addition, the user is freed from worry about a possible malfunction of the toilet system 10.

On the other hand, when the seating time is shorter than 11 seconds, both the "heart rate" and the "stress state" are stopped to be outputted. Thus, it is effectively inhibited that any health index that is likely to incorrectly reflect the user's actual health status is outputted as correctly reflecting the user's actual health status. Therefore, it is effectively inhibited that unnecessary confusion and/or upset is given to the user who daily takes care of his or her health with reference to the health indices obtained via the toilet system.

First Operation Example: Variant

According to the above first operation example, before the seating time reaches 11 seconds (NO at STEP 13), if the capacitance sensor 50 detects the user's leaving the seat surface 21 (YES at STEP 14), the controller 70 is configured to cause the communication part 75 (health index output part) to stop outputting the "heart rate" (an example of a first health index) and also to stop outputting the "stress state" (an example of a second health index) (STEP 15). Instead of this manner, the controller 70 may be configured to cause the communication part 75 (health index output part) to output error information for both the "heart rate" (an example of a first health index) and the "stress state" (an example of a second health index).

The error information may be outputted together with an output of the "heart rate" and/or the "stress state" that are likely to incorrectly reflect the user's actual health status. Alternatively, the error information may be outputted instead of (without) such an output of the "heart rate" and/or the "stress state".

Similarly, according to the above first operation example, before the seating time reaches 61 seconds (NO at STEP 16), if the capacitance sensor 50 detects the user's leaving the seat surface 21 (YES at STEP 17), the controller 70 is configured to cause the communication part 75 (health index output part) to output (the first calculated value of) the "heart rate" but stop outputting the "stress state" (STEP 18). Instead of this manner, the controller 70 may be configured to cause the communication part 75 (health index output part) to output (the first calculated value of) the "heart rate" and to output error information for the "stress state".

The error information may be outputted together with an output of the "stress state" that is likely to incorrectly reflect the user's actual health status. Alternatively, the error information may be outputted instead of (without) such an output of the "stress state".

Second Operation Example: Operation

Figure 7:
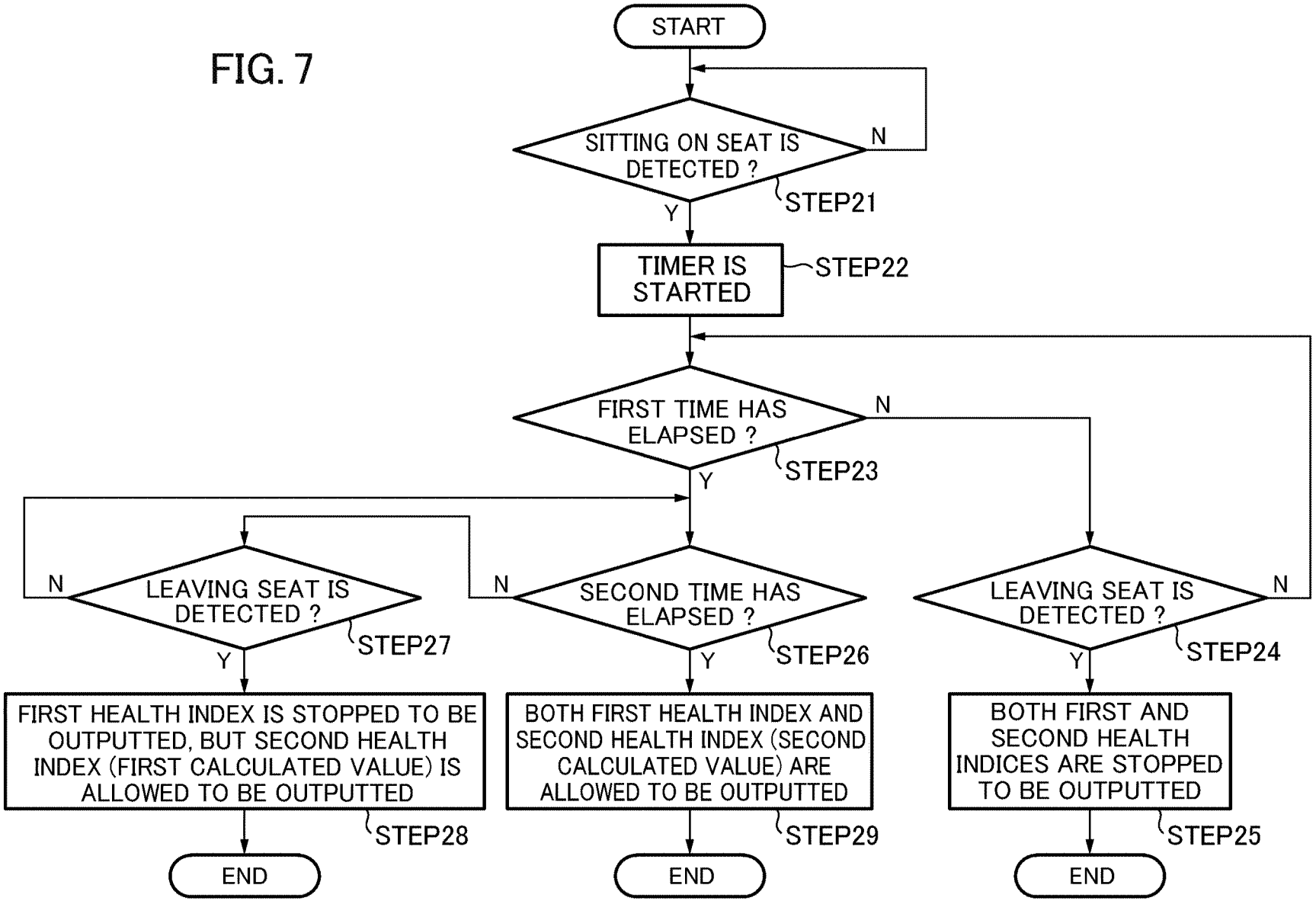
FIG. 7 is a flowchart showing a second operation example of the toilet system shown in FIG. 1.

A second operation example of the toilet system 10 according to the present embodiment is explained with reference to FIG. 7. As shown in FIG. 7, the controller 70 determines whether a user sits on the seat surface 21 or not (STEP 21). When it is determined that no user has sat on the seat surface 21 yet (NO at STEP 21), this determining step is repeatedly performed.

When it is determined that a user has sat on the seat surface 21 (YES at STEP 21), a measurement of a seating time by the timer 95 is started (STEP 22). In parallel, a calculation process for a plurality of health indices of the user is started by the health index calculator 60 based on measurement results of the laser sensor 40 (in this example, a first calculated value of a "heart rate" is calculated by taking 11 seconds (an example of a first required time), and a second calculated value of the "heart rate" and a "stress state" are calculated by taking 61 seconds (an example of a second required time)).

Subsequently, the controller 70 determines whether the seating time has reached or exceeded 11 seconds (an example of a first required time) (YES) or has not reached 11 seconds yet (NO) (STEP 23).

Before the seating time reaches 11 seconds (NO at STEP 23), if the capacitance sensor 50 detects the user's leaving the seat surface 21 (YES at STEP 24), the controller 70 is configured to cause the communication part 75 (health index output part) to stop outputting the "heart rate" (an example of a first health index) and also to stop outputting the "stress state" (an example of a second health index) (STEP 25).

After the seating time has reached or exceeded 11 seconds (YES at STEP 23), subsequently, the controller 70 determines whether the seating time has reached or exceeded 61 seconds (an example of a second required time) (YES) or has not reached 61 seconds yet (NO) (STEP 26).

Before the seating time reaches 61 seconds (NO at STEP 26), while the capacitance sensor 50 does not detect the user's leaving the seat surface 21 (NO at STEP 27), it is waited for the seating time to reach or exceed 61 seconds (back to STEP 26).

Before the seating time reaches 61 seconds (NO at STEP 26), if the capacitance sensor 50 detects the user's leaving the seat surface 21 (YES at STEP 27), the controller 70 is configured to cause the communication part 75 (health index output part) to output (the first calculated value of) the "heart rate" but stop outputting the "stress state" (STEP 28).

After the seating time has reached or exceeded 61 seconds (YES at STEP 26), the controller 70 is configured to cause the communication part 75 (health index output part) to output the second calculated value of the "heart rate" and also output the calculated "stress state" (STEP 29). That is to say, with respect to the "heart rate", instead of the first calculated value based on the measurement data for 10 seconds, the second calculated value based on the measurement data for 60 seconds (the measurement data obtained by taking a longer time) is outputted.

Second Operation Example: Effect

According to the second operation example as described above, when the seating time is not shorter than 11 seconds but shorter than 61 seconds, the calculated value of the "heart rate", which has not been outputted in this case in the conventional system, can be outputted. This output may be useful for the user. In addition, the user is freed from worry about a possible malfunction of the toilet system 10.

On the other hand, when the seating time is shorter than 11 seconds, both the "heart rate" and the "stress state" are stopped to be outputted. Thus, it is effectively inhibited that any health index that is likely to incorrectly reflect the user's actual health status is outputted as correctly reflecting the user's actual health status. Therefore, it is effectively inhibited that unnecessary confusion and/or upset is given to the user who daily takes care of his or her health with reference to the health indices obtained via the toilet system.

Furthermore, when the seating time is not shorter than 61 seconds, with respect to the "heart rate", the second calculated value based on the measurement data for 60 seconds (a longer time), which has been calculated with a higher degree of accuracy, is outputted instead of the first calculated value based on the measurement data for 10 seconds. This is more useful for the user who daily takes care of his or her health with reference to the health indices obtained via the toilet system 10.

Second Operation Example: Variant

According to the above second operation example as well, before the seating time reaches 11 seconds (NO at STEP 23), if the capacitance sensor 50 detects the user's leaving the seat surface 21 (YES at STEP 24), the controller 70 is configured to cause the communication part 75 (health index output part) to stop outputting the "heart rate" (an example of a first health index) and also to stop outputting the "stress state" (an example of a second health index) (STEP 25). Instead of this manner, the controller 70 may be configured to cause the communication part 75 (health index output part) to output error information for both the "heart rate" (an example of a first health index) and the "stress state" (an example of a second health index).

The error information may be outputted together with an output of the "heart rate" and/or the "stress state" that are likely to incorrectly reflect the user's actual health status. Alternatively, the error information may be outputted instead of (without) such an output of the "heart rate" and/or the "stress state".

Similarly, according to the above second operation example as well, before the seating time reaches 61 seconds (NO at STEP 26), if the capacitance sensor 50 detects the user's leaving the seat surface 21 (YES at STEP 27), the controller 70 is configured to cause the communication part 75 (health index output part) to output (the first calculated value of) the "heart rate" but stop outputting the "stress state" (STEP 28). Instead of this manner, the controller 70 may be configured to cause the communication part 75 (health index output part) to output (the first calculated value of) the "heart rate" and to output error information for the "stress state".

The error information may be outputted together with an output of the "stress state" that is likely to incorrectly reflect the user's actual health status. Alternatively, the error information may be outputted instead of (without) such an output of the "stress state".

SUPPLEMENTARY EXPLANATION ABOUT PROGRAM

The above various functions of the health index calculator 60, the controller 70 and the communication part 75 may be achieved by a microcomputer and the like which executes a corresponding program. Such a program, and a storage medium storing such a program, should be also protected by the present patent application.

For example, a program according to an aspect of the present invention is a program for providing a health index by using the toilet system 10, the toilet system including: the toilet seat 20 having the seat surface 21 on which a user is to sit; the laser sensor 40 provided in the toilet seat 20, configured to measure a physical quantity which reflects blood flow conditions of the user; and the timer 95 configured to measure a seating time during which the user continues to sit on the seat surface 21; the program being capable of perform, when executed by a computer: a health index calculating step of calculating a plurality of health indices of the user based on measurement results of the laser sensor 40; and a health index outputting step of outputting the plurality of health indices of the user which has been calculated by the health index calculating step, in accordance with an output manner depending on measurement results of the timer 95; wherein the plurality of health indices includes a first health index and a second health index; during the health index calculating step, the first health index is calculated by taking a first required time under a state wherein the user continues to sit on the seat surface 21, and the second health index is calculated by taking a second required time under a state wherein the user continues to sit on the seat surface 21, the second required time being longer than the first required time; during the health index outputting step: (1) the first health index which has been calculated by the health index calculating step is outputted, but the second health index which has been calculated by the health index calculating step is stopped to be outputted or such error information is outputted, when the seating time is not shorter than the first required time but shorter than the second required time, and (2) the first health index which has been calculated by the health index calculating step is outputted, and the second health index which has been calculated by the health index calculating step is also outputted, when the seating time is not shorter than the second required time.

Alternatively, a program according to another aspect of the present invention is a program for providing a health index by using the toilet system 10, the toilet system including: the toilet seat 20 having the seat surface 21 on which a user is to sit; the laser sensor 40 provided in the toilet seat 20, configured to measure a physical quantity which reflects blood flow conditions of the user; and the timer 95 configured to measure a seating time during which the user continues to sit on the seat surface 21; the program being capable of perform, when executed by a computer: a health index calculating step of calculating a plurality of health indices of the user based on measurement results of the laser sensor 40; and a health index outputting step of outputting the plurality of health indices of the user which has been calculated by the health index calculating step, in accordance with an output manner depending on measurement results of the timer 95; wherein the plurality of health indices includes a first health index and a second health index; during the health index calculating step, a first calculated value of the first health index is calculated by taking a first required time under a state wherein the user continues to sit on the seat surface 21, the second health index is calculated by taking a second required time under a state wherein the user continues to sit on the seat surface 21, the second required time being longer than the first required time, and a second calculated value of the first health index is calculated at a predetermined timing after the first required time has elapsed under a state wherein the user continues to sit on the seat surface 21; during the health index outputting step: (1) the first calculated value of the first health index which has been calculated by the health index calculating step is outputted, but the second health index which has been calculated by the health index calculating step is stopped to be outputted or such error information is outputted, when the seating time is not shorter than the first required time but shorter than the second required time, and (2) the second calculated value of the first health index which has been calculated by the health index calculating step is outputted, and the second health index which has been calculated by the health index calculating step is also outputted, when the seating time is not shorter than the second required time.

What is claimed is:

1. A toilet system comprising:

a toilet seat having a seat surface on which a user is to sit;

a sensor provided in or on the toilet seat, configured to measure a physical quantity which reflects blood flow conditions of the user;

a health index calculator configured to calculate a plurality of health indices of the user based on measurement results of the sensor;

a health index output part configured to output the plurality of health indices of the user which has been calculated by the health index calculator;

a timer configured to measure a seating time during which the user continues to sit on the seat surface; and a controller configured to control an output manner of the health index output part based on measurement results of the timer;

wherein the plurality of health indices includes a first health index and a second health index, the health index calculator is configured to calculate the first health index by taking a first required time under a state wherein the user continues to sit on the seat surface, and to calculate the second health index by taking a second required time under a state wherein the user continues to sit on the seat surface, the second required time being longer than the first required time, the controller is configured to cause the health index output part to (1) output the first health index which has been calculated by the health index calculator in a default manner, but handle the second health index which has been calculated by the health index calculator in a different manner than the default manner, when the seating time is not shorter than the first required time but shorter than the second required time, and (2) output the first health index which has been calculated by the health index calculator in the default manner, and also output the second health index which has been calculated by the health index calculator in the default manner, when the seating time is not shorter than the second required time.

2. The toilet system according to claim 1, wherein the controller is configured to cause the health index output part to (3) handle the first health index which has been calculated by the health index calculator in the different manner or in a second different manner than the default manner, and handle the second health index which has been calculated by the health index calculator in the different manner, in the second different manner or in a third different manner than the default manner, when the seating time is shorter than the first required time.

3. The toilet system according to claim 1, wherein the plurality of health indices includes one or a first group of health indices each of which functions as the first health index, and a second group of health indices each of which functions as the second health index, and the number of the second group of health indices is larger than the number of the first group of health indices.

4. A toilet system comprising:

a toilet seat having a seat surface on which a user is to sit;

a sensor provided in or on the toilet seat, configured to measure a physical quantity which reflects blood flow conditions of the user;

a health index calculator configured to calculate a plurality of health indices of the user based on measurement results of the sensor;

a health index output part configured to output the plurality of health indices of the user which has been calculated by the health index calculator;

a timer configured to measure a seating time during which the user continues to sit on the seat surface; and a controller configured to control an output manner of the health index output part based on measurement results of the timer;

wherein the plurality of health indices includes a first health index and a second health index, the health index calculator is configured to calculate a first calculated value of the first health index by taking a first required time under a state wherein the user continues to sit on the seat surface, to calculate the second health index by taking a second required time under a state wherein the user continues to sit on the seat surface, the second required time being longer than the first required time, and to calculate a second calculated value of the first health index at a predetermined timing after the first required time has elapsed under a state wherein the user continues to sit on the seat surface, the controller is configured to cause the health index output part to (1) output the first calculated value of the first health index which has been calculated by the health index calculator in a default manner, but handle the second health index which has been calculated by the health index calculator in a different manner than the default manner, when the seating time is not shorter than the first required time but shorter than the second required time, and (2) output the second calculated value of the first health index which has been calculated by the health index calculator in the default manner and output the second health index which has been calculated by the health index calculator in the default manner, when the seating time is not shorter than the second required time.

5. The toilet system according to claim 4, wherein the controller is configured to cause the health index output part to (3) handle the first health index which has been calculated by the health index calculator in the different manner or in a second different manner than the default manner, and handle the second health index which has been calculated by the health index calculator in the different manner, in the second different manner or in a third different manner than the default manner, when the seating time is shorter than the first required time.

6. A method of providing a health index by using a toilet system comprising:

a toilet seat having a seat surface on which a user is to sit;

a sensor provided in or on the toilet seat, configured to measure a physical quantity which reflects blood flow conditions of the user; and a timer configured to measure a seating time during which the user continues to sit on the seat surface;

the method comprising:

a health index calculating step of calculating a plurality of health indices of the user based on measurement results of the sensor; and a health index outputting step of outputting the plurality of health indices of the user which has been calculated by the health index calculating step, in accordance with an output manner depending on measurement results of the timer;

wherein the plurality of health indices includes a first health index and a second health index;

during the health index calculating step, the first health index is calculated by taking a first required time under a state wherein the user continues to sit on the seat surface, and the second health index is calculated by taking a second required time under a state wherein the user continues to sit on the seat surface, the second required time being longer than the first required time;

during the health index outputting step, (1) the first health index which has been calculated by the health index calculating step is outputted in a default manner, but the second health index which has been calculated by the health index calculating step is handled in a different manner than the default manner, when the seating time is not shorter than the first required time but shorter than the second required time, and (2) the first health index which has been calculated by the health index calculating step is outputted in the default manner, and the second health index which has been calculated by the health index calculating step is also outputted in the default manner, when the seating time is not shorter than the second required time.

7. A method of providing a health index by using a toilet system comprising:

a toilet seat having a seat surface on which a user is to sit;

a sensor provided in or on the toilet seat, configured to measure a physical quantity which reflects blood flow conditions of the user; and a timer configured to measure a seating time during which the user continues to sit on the seat surface;

the method comprising:

a health index calculating step of calculating a plurality of health indices of the user based on measurement results of the sensor; and a health index outputting step of outputting the plurality of health indices of the user which has been calculated by the health index calculating step, in accordance with an output manner depending on measurement results of the timer;

wherein the plurality of health indices includes a first health index and a second health index;

during the health index calculating step, a first calculated value of the first health index is calculated by taking a first required time under a state wherein the user continues to sit on the seat surface, the second health index is calculated by taking a second required time under a state wherein the user continues to sit on the seat surface, the second required time being longer than the first required time, and a second calculated value of the first health index is calculated at a predetermined timing after the first required time has elapsed under a state wherein the user continues to sit on the seat surface;

during the health index outputting step, (1) the first calculated value of the first health index which has been calculated by the health index calculating step is outputted in a default manner, but the second health index which has been calculated by the health index calculating step is handled in a different manner than the default manner, when the seating time is not shorter than the first required time but shorter than the second required time, and (2) the second calculated value of the first health index which has been calculated by the health index calculating step is outputted in the default manner, and the second health index which has been calculated by the health index calculating step is also outputted in the default manner, when the seating time is not shorter than the second required time.

8. A program for providing a health index by using a toilet system comprising:

a toilet seat having a seat surface on which a user is to sit;

a sensor provided in or on the toilet seat, configured to measure a physical quantity which reflects blood flow conditions of the user; and a timer configured to measure a seating time during which the user continues to sit on the seat surface;

the program is capable of perform, when executed by a computer:

a health index calculating step of calculating a plurality of health indices of the user based on measurement results of the sensor; and a health index outputting step of outputting the plurality of health indices of the user which has been calculated by the health index calculating step, in accordance with an output manner depending on measurement results of the timer;

wherein the plurality of health indices includes a first health index and a second health index;

during the health index calculating step, the first health index is calculated by taking a first required time under a state wherein the user continues to sit on the seat surface, and the second health index is calculated by taking a second required time under a state wherein the user continues to sit on the seat surface, the second required time being longer than the first required time;

during the health index outputting step, (1) the first health index which has been calculated by the health index calculating step is outputted in a default manner, but the second health index which has been calculated by the health index calculating step is handled in a different manner than the default manner, when the seating time is not shorter than the first required time but shorter than the second required time, and (2) the first health index which has been calculated by the health index calculating step is outputted in the default manner, and the second health index which has been calculated by the health index calculating step is also outputted in the default manner, when the seating time is not shorter than the second required time.

9. A program for providing a health index by using a toilet system comprising:

a toilet seat having a seat surface on which a user is to sit;

a sensor provided in or on the toilet seat, configured to measure a physical quantity which reflects blood flow conditions of the user; and a timer configured to measure a seating time during which the user continues to sit on the seat surface;

the program is capable of perform, when executed by a computer:

a health index calculating step of calculating a plurality of health indices of the user based on measurement results of the sensor; and a health index outputting step of outputting the plurality of health indices of the user which has been calculated by the health index calculating step, in accordance with an output manner depending on measurement results of the timer;

wherein the plurality of health indices includes a first health index and a second health index;

during the health index calculating step, a first calculated value of the first health index is calculated by taking a first required time under a state wherein the user continues to sit on the seat surface, the second health index is calculated by taking a second required time under a state wherein the user continues to sit on the seat surface, the second required time being longer than the first required time, and a second calculated value of the first health index is calculated at a predetermined timing after the first required time has elapsed under a state wherein the user continues to sit on the seat surface;

during the health index outputting step, (1) the first calculated value of the first health index which has been calculated by the health index calculating step is outputted in a default manner, but the second health index which has been calculated by the health index calculating step is handled in a different manner than the default manner, when the seating time is not shorter than the first required time but shorter than the second required time, and (2) the second calculated value of the first health index which has been calculated by the health index calculating step is outputted in the default manner, and the second health index which has been calculated by the health index calculating step is also outputted in the default manner, when the seating time is not shorter than the second required time.

* * * * *